United States Patent [19]

Steinke et al.

[11] 4,087,904

[45] May 9, 1978

[54] METHOD TO MANUFACTURE GLOW PLUGS, PARTICULARLY TO SECURE GLOW ELEMENTS IN SOCKETS

[75] Inventors: Leo Steinke, Waiblingen-Hegnach; Josef Tosch, Schwieberdingen, both of Germany

[73] Assignee: Robert Bosch GmbH, Stuttgart, Germany

[21] Appl. No.: 759,130

[22] Filed: Jan. 13, 1977

[30] Foreign Application Priority Data

Mar. 6, 1976 Germany ..... 2609294

[51] Int. Cl.[2] ..... H05B 3/00

[52] U.S. Cl. ..... 29/611; 29/525; 219/267; 123/179 H; 361/266

[58] Field of Search ..... 29/611, 613, 525; 361/264, 266; 219/260, 267, 270; 123/179 H

[56] References Cited

U.S. PATENT DOCUMENTS

| | | | |
|---|---|---|---|
| 2,996,801 | 8/1961 | Klossika | 29/525 |
| 3,164,748 | 1/1965 | Testerni | 219/260 |
| 3,749,980 | 7/1973 | Baxter | 219/267 |

FOREIGN PATENT DOCUMENTS

| | | | |
|---|---|---|---|
| 611,659 | 10/1960 | Italy | 361/264 |
| 11,648 | 4/1970 | Japan | 123/179 H |

*Primary Examiner*—Lowell A. Larson
*Attorney, Agent, or Firm*—Flynn & Frishauf

[57] ABSTRACT

A thin-walled closed metal sleeve in which a heating wire is placed is attached in a socket which is formed with a bore with a carefully smoothly finished inner surface free from grooves or ridges and accurately dimensioned to a predetermined diameter; the outer diameter of the glow plug sleeve is formed to be just slightly larger and the sleeve is then press-fitted, after having been axially aligned with the bore by axially pressing it into the bore; preferably, the end portion of the bore through which the sleeve is inserted is slightly chamfered or funnel-shaped. The manufacturing step of dimensioning and finishing the bore is preferably carried out by ball calibration, that is, by pressing a hardened steel ball therethrough.

10 Claims, 1 Drawing Figure

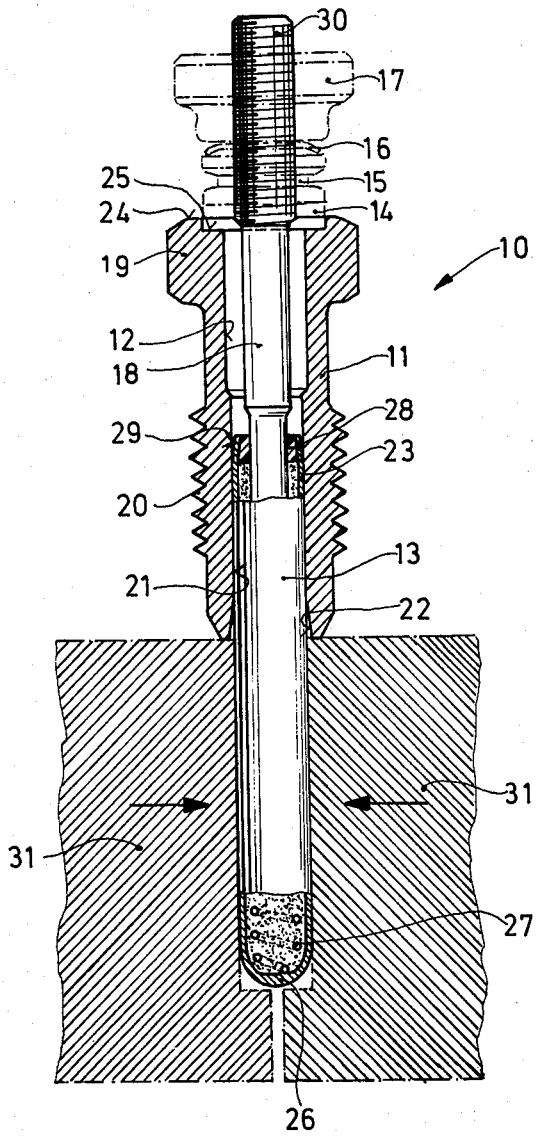
30
17
16
25
15
24
14
19
10
12
18
11
28
29
23
20
13
21
22
31
31
27
26

METHOD TO MANUFACTURE GLOW PLUGS, PARTICULARLY TO SECURE GLOW ELEMENTS IN SOCKETS

The present invention relates to glow elements, or glow plugs, for example of the type used in internal combustion engines, and more particularly to a method to manufacture such glow plugs which is economical, effective, and results in manufactured articles of high reliability and low failure rates or rejects during manufacture.

BACKGROUND AND PRIOR ART

Glow plugs of the type usually used employ a thin metal sleeve which is set into a socket. The metal sleeve is closed at one end. An electrically insulating material which is a good conductor of heat is included in the closed sleeve. An electrical heating resistance wire is coiled within the insulating material. The assembly of the metal sleeve with the insulating material and the heating wire is fixed in a socket where it must be securely held.

It is difficult to connect the metal sleeve to the socket. If welding is used, difficulties arise due to the substantial difference in wall thickness between the sleeve and the socket. The wall thickness of the sleeve should be as thin as possible to provide good heat transfer from the resistance wire and to ensure rapid heating.

In some plugs, the heating or glow sleeve has been formed like a pin and, by using special sealing materials, the sleeve has been screwed into the socket. In another construction, a metal sleeve is held in the socket by means of a glass melt. These methods of securing the sleeve to the socket are expensive to carry out and do not satisfy long operating requirements particularly with respect to the seal between the metal sleeve and the socket. If has also been proposed to secure the sleeves in the sockets by means of hard-soldering or brazing. This step can be carried out only in an atmosphere of protective gas in order to obtain a reliable solder or brazing connection. The solder connection results in a good plug which satisfies functional requirements; the method of manufacturing such a plug is, however, expensive. A further problem arises in soldering or brazing: sealing elements which may be placed at the terminal end of the glow plug may be damaged when introducing sufficient heat to effect brazing or welding, if the terminal end is at, or close to the soldering or brazing region. To protect any non-metallic elements it is necessary to extend the length of the glow plug so that the end portion is sufficiently for removed from the solder or brazing region.

A widely used method to connect the glow plug sleeve and the metal socket is: The glow tube is introduced into a bore of the socket with some play; the portion of the socket which is closest to the combustion chamber — when the glow plug is installed in an internal combustion engine, such as a Diesel engine — is then compressed from the outside. This requires quite complicated machinery which is expensive.

It has also been proposed to connect the thin-walled glow plug metal sleeve with the socket by shrinking a sleeve of steel on the thin-walled glow plug sleeve and then press-fitting the steel bushing into a bore of the socket. Rather than shrinking the steel bushing on the glow plug tube, it has also been proposed to solder the sleeve thereon. This solution to the manufacture of glow plugs has not found favor in industry due to the high costs and the difficulty of effecting a reliable connection.

THE INVENTION

It is an object of the present invention to provide a method to manufacture glow plugs, and more particularly to secure a glow plug sleeve in a socket which is inexpensive to carry out, uses only simple and readily available tools or machinery, requires but little time for its manufacturing step and little material, while providing a reliable gas-tight attachment of the glow plug sleeve to the socket, resulting in a long life of the manufactured glow plug.

Briefly, the terminal end of the socket intended for placement within the combustion chamber of an internal combustion engine, and the outer end of the sleeve, intended for location outside of the internal combustion engine, are aligned; the socket is formed with a bore which is accurately dimensioned as to size, and free from burrs, grooves, ridges, or other surface imperfections. In a preferred form, the bore is simultaneously dimensioned and finished by ball sizing, that is, by pressing a ball therethrough. The glow plug sleeve, which is slightly oversized with respect to the bore, is then pressed into the aligned bore to fit therein with a press or interference fit.

The glow plug sleeve, which is of thin-walled metal, could be damaged during the insertion step; in accordance with a feature of the invention, therefore, the glow plug sleeve is clamped between a tong-like holder. In accordance with a preferred form, the longitudinal bore of the socket and/or the end of the glow plug sleeve which is introduced through the bore are chamfered or formed with a taper to ensure accurate axial alignment.

DRAWING

The single FIGURE illustrates, in cross section, a finished glow plug and a clamp jig used in the manufacturing method.

The FIGURE is drawn to an enlarged scale. Elements used with the glow plug but not forming part of the method of the present invention have been shown in chain-dotted lines. The glow plug 10 has a metallic housing 11 forming a socket. A longitudinal bore 12 extends through the socket. A glow plug sleeve 13, for example of about 6 mm diameter, is pressed through the bore 12 of the socket. At the connecting or outer end, the pin 13 is surrounded by an insulating ring 14, a circular nut 15, a spring disk 16 and a connecting nut 17, all stacked and threaded to a threaded extension 30 formed on a bolt end 18 of the glow plug.

The socket 11 is formed with an outer hexagonal wrench engaging surface 19 and with a thread 20 for screwing into the motor block of an internal combustion engine. The longitudinal bore 12 of the housing is formed with a compression zone 21 in the region adjacent the internal combustion side of the glow plug. The region 21 of the bore 12 is smaller than the diameter of the remainder of the longitudinal bore 12. Its surface is smooth, free of ridges, grooves, striations, burrs, and is accurately dimensioned. This compression surface is preferably made by ball calibrating; this is a method in which a hard steel ball of the required diameter, and with a polished, extremely smooth surface, is pressed through the longitudinal bore to be sized, that is, through bore 12 and particularly through the region 21.

The end of the bore 12 adjacent zone 21 and immediately adjacent the end which is to be introduced into the combustion chamber is chamfered as seen at 22, the taper of the chamfered surface merging smoothly with the longitudinal bore 12. A thin-walled glow plug sleeve 23 of oxidation-resistant metal is introduced into the bore 12 and seated in the region 21. The socket 11 is additionally formed at the outer end 24 with a recess 25 forming an inner shoulder, to at least partially receive the insulating ring 14.

The glow plug sleeve 13 is a subassembly formed of the metal sleeve 23, having a wall thickness of about 0.7mm. The end portion extending into the combustion chamber of the internal combustion engine with which the glow plug is intended to be used is closed and welded together to form a welded bottom 26. One end of a resistance wire 27 is additionally secured to the closed bottom by being welded thereto. The resistance wire 27 is internally spiralled and extends within the metal sleeve 23; the respective turns of the spiral do not touch and do not touch the metal sleeve 23. The other end of the resistance wire 27 is connected to one of the terminal bolt 18 by welding (not shown). The metal sleeve 23 is spaced from bolt 18 by means of a sealing ring 28 formed of heat-resistant material, for example a fluor plastic known under the trademark "Viton". The remaining space within the metal sleeve 23 is filled with an electrically insulating and good heat conductive compressed material, for example magnesium oxide. The end of the sleeve 23 adjacent the terminal portion 30 is inwardly tapered, as seen at 29, in order to facilitate alignment in introduction of the sleeve 13 into the socket 11. Depending on size and type of the glow plug 10, it may be sufficient if the longitudinal bore 12 alone is tapered or chamfered, as seen at 22, or if only the glow plug sleeve 13 is tapered or formed with a reduced diameter as seen at 29.

The insulating ring 14, nut 15, spring disk 16 and terminal nut 17 are stacked and threaded on the threaded end 30; after assembly of the glow plug sleeve 13 into the glow plug, the nut 15 is additionally secured to the thread 30, for example by a punch or other deformation step.

Manufacture of the glow plug: The preassembled glow plug sleeve 13 and the socket 11 are clamped in a clamp jig shown at 31. The outer end of the glow plug sleeve, that is, the end having the bolt 18, extends from the jig 31 by a predetermined dimension, namely that dimension which is to extend through the socket 11 and therebeyond, as shown in the figure. The housing 11 is secured in a suitable holder (not shown). Housing 11 and the sleeve 13 are axially aligned in their holders. The outer diameter of sleeve 23 is slightly greater than the inner diameter of the accurately dimensioned portion 21 of the bore 12 of socket 11. A lubricant, not separately shown in the drawing, is used to wet the portion of the sleeve 23 extending from jig 31 and/or the portion 21 of bore 12. The projecting portion of the sleeve 23 is introduced into the bore 12 and the elements are pressed together over a predetermined distance. The over-size of the metal sleeve 23 with respect to the inner diameter of the bore portion 21 is, suitably, for the above given dimensions about 100 μm. A suitable lubricant is molybdenum sulfite which, when making this connection, simultaneously serves as an additional sealing element.

The invention is not restricted to the type of glow plug shown in the drawing, but it may be used also with flame-type glow plugs.

The sleeve 23 of the glow plug can be made of an customary material, for example a heat-resisting chrome-nickel-alloy.

Various changes and modifications may be made within the scope of the inventive concept.

I claim:

1. In the manufacture of glow plugs, a method of securing a glow element (23) in a socket of the glow plug (10) in which the glow element comprises a thin-walled, closed metal sleeve (23), a heating wire (27) within the sleeve, and a filling of good heat-conductive insulating material within the sleeve and surrounding the heating wire;

and in which the socket comprises a metallic body (11) formed with a bore (12) therethrough, said method comprising the steps of smoothly finishing at least a zone (21) of the bore (12) to be free from grooves, ridges, or surface imperfections and discontinuities at its inner walls, and having an accurate size of predetermined diameter;

forming the outer diameter of the sleeve to have a slightly larger diameter than said predetermined diameter of the zone (21) of the socket (11);

guiding the sleeve (23) and the bore (12) in the body (11) in axial alignment;

and press-fitting the sleeve into the bore by relatively moving the sleeve and the body, in axial alignment, over a predetermined distance to seat the sleeve in the bore by an interference fit and hold the sleeve gas-tight in the bore by radial pressure of the socket against the wall of the sleeve.

2. Method according to claim 1, including the step of clamping the sleeve (23) in tong-like clamps (31).

3. Method according to claim 1, wherein the terminal portion of the bore (12) formed in the socket (11) extending towards the end of the glow plug sleeve and having the wire therein is formed with a chamfered or relieved surface (22) to facilitate insertion of the sleeve (23) into the bore (12).

4. Method according to claim 1, wherein the end portion of the sleeve (23) introduced during the insertion step into the bore (12) is formed with an inwardly relieved or chamfered surface (29) to facilitate introduction of the sleeve (23) into the bore.

5. Method according to claim 3, wherein the end portion of the sleeve (23) introduced during the insertion step into the bore (12) is formed with an inwardly relieved or chamfered surface (29) to facilitate introduction of the sleeve (23) into the bore.

6. Method according to claim 1, wherein the step of smoothly finishing the zone of the bore and accurately determining its diameter comprises ball-calibrating at least said zone (21) of the bore (12).

7. Method according to claim 1, wherein the over-size of sleeve (23) with respect to the diameter of said zone (21) of the bore (12) is in the order of about 100 μm.

8. Method according to claim 1, wherein the sleeve (23) has an outer diameter in the order of about 6 mm; the wall thickness of the sleeve is in the order of about 0.7 mm; the over-size of the sleeve with respect to said zone (21) of the bore (12), before insertion into the bore, is in the order of about 100 μm; the end portions of at least one of: said sleeve (23); said socket (11) being joined during said introduction step being chamfered or relieved to be formed with a tapered surface (22; 29);

and further comprising the step of lubricating at least one of: the portion of the sleeve (23) being inserted in said bore (12); said zone (21) of the bore (12) with a lubricant which, in use of the plug, forms a sealer.

9. Method according to claim 8, wherein said lubricating step comprises lubricating with molybdenum sulfite.

10. Method according to claim 9, wherein the smooth finishing and accurately dimensioning step comprises ball-calibrating at least said zone (21) of the bore, and said guiding and press-fitting step includes the step of clamping a portion of the sleeve (23) in a clamp jig (31) essentially circumferentially surrounding the sleeve (23).

* * * * *